US006298648B1

(12) United States Patent
D'Agnolo

(10) Patent No.: US 6,298,648 B1
(45) Date of Patent: Oct. 9, 2001

(54) MULTIPLE TWIST SPINDLE

(76) Inventor: Armando D'Agnolo, Via Zuccolo, 58 - 33080, Porcia (PN) (IT)

( * ) Notice: Subject to any disclaimer, the term of this patent is extended or adjusted under 35 U.S.C. 154(b) by 0 days.

(21) Appl. No.: 09/445,276

(22) PCT Filed: Jun. 4, 1998

(86) PCT No.: PCT/IB98/00867

§ 371 Date: Dec. 3, 1999

§ 102(e) Date: Dec. 3, 1999

(87) PCT Pub. No.: WO98/55675

PCT Pub. Date: Dec. 10, 1998

(30) Foreign Application Priority Data

Jun. 5, 1997 (IT) ..... UD97A0104

(51) Int. Cl.[7] ..... D01H 7/86

(52) U.S. Cl. ..... 57/58.49; 57/58.52; 57/58.61; 57/58.76; 57/58.83; 57/58.84; 57/81; 57/88; 57/100; 57/263; 57/264; 57/312

(58) Field of Search ..... 57/58.49, 58.52, 57/58.61, 58.76, 58.83, 58.84, 81, 88, 100, 263, 264, 312

(56) References Cited

U.S. PATENT DOCUMENTS

| | | | | |
|---|---|---|---|---|
| 3,956,875 | * | 5/1976 | Lenorak | 57/58.61 |
| 5,150,566 | * | 9/1992 | Stenmans | 57/58.83 |
| 5,303,550 | * | 4/1994 | Setzer | 57/58.36 |
| 5,361,571 | * | 11/1994 | Joyce | 57/58.76 |

FOREIGN PATENT DOCUMENTS

| | | | |
|---|---|---|---|
| 2005223 | * | 9/1970 | (DE) . |
| 20 05 223 A | | 9/1970 | (DE) . |
| 0 231 807 A | | 8/1987 | (EP) . |
| 0 611 841 A | | 8/1994 | (EP) . |
| 2 235 217 | | 1/1975 | (FR) . |
| 47-40100 | | 10/1972 | (JP) . |
| 47-33246 | | 12/1972 | (JP) . |
| 50-135347 | | 10/1975 | (JP) . |
| 07 268732 A | | 2/1996 | (JP) . |

* cited by examiner

*Primary Examiner*—John J. Calvert
*Assistant Examiner*—Shaun R Hurley
(74) *Attorney, Agent, or Firm*—Akin, Gump, Strauss, Hauer & Feld, L.L.P.

(57) ABSTRACT

Multiple twist spindle to impart two+two twists to textile yarns and threads, whether they be continuous filaments or discontinuous fibres, the spindle comprising a spindle support (16) which supports a support (13) for the feed bobbin (12) maintained substantially stationary and two counter-rotating parts, respectively the inner rotary part (18*a*) and the outer rotary part (18*b*), the counter-rotating parts (18*a*, 18*b*) being coaxial to each other and substantially coaxial to the axis (19) of the spindle (10), the thread (F) unwinding from the feed bobbin (12) and leaving the inversion element (15) located above the bobbin (12) is induced by the counter-rotating parts (18*a*, 18*b*) to follow a path which first descends and then ascends, and then sent to collection means, the paths defining respectively an inner balloon (11*a*) and an outer balloon (11*b*) rotating outside the feed bobbin (12), the thread (F) receiving two twists for each revolution of each of the counter-rotating parts (18*a*, 18*b*), there being included above the feed bobbin (12) at least a tensioning device (14), wherein all the commands and supports for the counter-rotating parts (18*a*, 18*b*), the supports for the tensioning device (14) and the supports for the upper inversion element (15) are all located on a single side of the spindle (10) where there is the spindle support (16), the bobbin (12) being located inside a substantially container (42) which extends substantially from the spindle support (16) to the upper inversion element (15), the inner balloon (11*a*) with a descending path assuming a path which is at least partly collapsed on the outer wall of the container (42) while the outer balloon (11*b*) with an ascending path expanded outwards assumes a substantially free path guided only in one portion of its lower part.

19 Claims, 2 Drawing Sheets

MULTIPLE TWIST SPINDLE

FIELD OF APPLICATION

This invention concerns a multiple twist spindle as set forth in the main claim.

The multiple twist spindle according to the invention is used to impart two+two (four) twisting actions, for each revolution of each of the rotary parts, in the thread or threads whether consisting of continuous filaments or discontinuous fibres; the spindle according to the invention is correctly applied in the field of the preparation of textile yarns which are employed mainly in the clothing and furnishing industries.

STATE OF THE ART

The twisting of several threads or tail ends, or of a thread consisting of filaments, whether they be continuous or discontinuous, was traditionally carried out—and is still carried out—either with ring twisters or up-twisters.

At the beginning of the 60s the two-for-one twisting procedure was introduced, initially for discontinuous threads and later for continuous threads and filaments; this method was characterised by the fact that for each revolution of the rotary part two twists are applied to the thread.

After this innovation, a large number of innovative processes were introduced onto the market in the field of the production of thread, both continuous and discontinuous; in the field of twisting, on the contrary, there was no innovation, despite the high cost of the process.

It was only at the beginning of 1990 that a process to impart a triple twist to the thread was put on the market.

This process is similar to that of the two-for-one twist process, wherein the feed bobbin, instead of remaining stationary, is made to rotate in the appropriate manner.

However, this method has considerable limits in its application due to the high absorption of power by the rotary parts which consist of two containers.

Twisting systems with four twists have also been proposed; however, these have not found any industrial application, at least in textile threads for the clothing and furnishing industry, as they present a plurality of disadvantages.

For example, DE-A-2.005.223, FR-A-2.235.217 and EP-A-231.807 describe four-twist twisting devices for cords, which include extremely complex and cumbersome systems to command the rotary parts, which give very low operating speeds, involve high tensions on the thread and very high absorption of energy; consequently, it is impossible to use them in an industrial application for textile threads.

Moreover, the command systems they use necessarily require a substantially horizontal arrangement which makes it complex to install them on the machines and extremely difficult to load and thread.

EP-A-611.841, JP-A-72 68732, JP-A-47 33246, JP-A47 40100 and JP-A-50 135347 describe four-twist twisting devices with a vertical working axis, which differ from each other in the system to command the inner part of the spindle.

The devices described in these patents have a first limitation to their industrial application in that the thread exits from the bottom, which makes them complex to use on the machines.

Furthermore, there is an intermediate container between the inner balloon and the outer balloon, which drastically limits their use for continuous-filament, chemical-fibre yarns, where there can be no contact or friction between the inner balloon and the container.

This problem can be overcome by suitably increasing the size of the container, but in this way the outer balloon is obliged to assume very large dimensions, which is not acceptable due to the excessive tensions which are generated on the thread.

Due to this arrangement, with the path of the thread exiting from the bottom and with the consequent inversions in its direction, the tensions on the thread are such that they make it impossible to increase actual production, except perhaps a small increase, compared with a normal two-for-one twist spindle such as the spindle might be considered without the return path of the thread.

In fact, the path described in these documents involves three changes of direction; a first when the thread enters inside the support of the bobbin of the first spindle, a second when it exits from the first spindle in order to form the inner balloon, and a third between the inner balloon and the outer balloon. Finally, there is a further diversion of 90° due to the axial exit of the thread from the bottom.

In order to overcome the problems posed by systems using multiple twists such as are known to the state of the art, achieving a spindle which is quite similar to a two-for-one twist spindle in design, arrangement, measurements, weights fed, and all the operations performed by the worker, increasing production while at the same time reducing the consumption of energy and the overall costs of twisting and also to obtain further advantages as shown hereinafter, the present Applicants have designed and tested this invention.

DISCLOSURE OF THE INVENTION

The invention is set forth and characterised in the main claim, while the dependent claims describe variants of the idea of the main embodiment.

The purpose of the invention is to achieve a multiple twist spindle (two+two) similar to a two-for-one twister spindle in its design, arrangement, measurements, weights fed, and all the operations performed by the worker, which will increase production (or rather the twists per minute) by 1.5÷2 times compared with the two-for-one spindle mentioned above, reducing by the same ratio the space occupied and the times needed to prepare and deliver a batch of textile threads, and also reducing energy consumption by 20÷35%.

The invention provides to use substantially the concept which inspired the two-for-one twist spindle; that is to say, a feed bobbin or bobbins placed on the axis of the spindle on a spindle support and held stationary by means of magnetic systems.

The spindle according to the invention differs from a two-for-one spindle in that the thread which unwinds upwards from the bobbin, instead of descending inside the bobbin support, exits from the upper inversion element of the spindle, which normally consists of a ceramic ring, so as to follow a first path which descends on the outside of the container inside which there is the bobbin; then, the thread inverts direction at a position below the spindle and substantially in axis therewith, and then goes up again on an ascending return path as in a two-for-one twist spindle.

Consequently, the number of times the thread inverts direction is limited to two, as in a normal two-for-one twist spindle.

According to the invention, the bobbin is located inside a substantially closed container which extends as far as the uppermost point where the path of the thread is inverted, as defined by the ceramic element placed above the container itself; this container is supported by the spindle support.

The container may include a cover at the upper part, or it may be possible to partly open and/or remove the container itself, in order to allow the bobbin to be loaded.

The thread, under working conditions, forms two counter-rotating balloons, respectively an inner balloon and an outer balloon which is expanded outwards; the two balloons are not separated by separating elements, they are arranged very close together and properly controlled so that there is no contact or interference.

The first balloon, or inner balloon, is defined between the outlet from the ceramic element located above the container and a system to invert the direction of the thread, for example a roller, located inside the main rotary part and below the bobbin itself; the second balloon, or outer balloon, is defined between the inversion-of-direction system and the thread loop located outside and above the spindle.

For each of these paths, the thread receives two twists for each revolution of the relative rotary part.

The inner balloon, by using the appropriate tensions and speeds, is taken to assume a collapsed or at least partly collapsed path; it develops in a very sloping spiral, and consequently it is always maintained very near the outer wall of the container inside which the bobbin is located.

To be more exact, at the segments where the thread begins and ends its descent the inner balloon is substantially in contact with, or at least brushes against this outer wall.

The contact between the inner balloon and the wall of the container, however, does not constitute a problem, even for continuous-filament, chemical-fibre threads, inasmuch as, in the case of the invention, due to the tensions of the collapsed balloon, the thread exerts a very low specific pressure on the wall of the container and therefore the fibres are not damaged.

Moreover, the contact or partial contact of the thread on the wall of the container optimises the control and stabilisation of the inner balloon and the relative tensions.

According to a variant, the first segment of the inner balloon exiting the upper ceramic element cooperates with a friction element which encourages the formation of a collapsed balloon.

This friction element has a surface in contact with the thread leaving the upper ceramic element which causes a delaying effect on the thread itself, which thus does not leave the container in a linear manner but substantially forms a kind of loop facing backwards with respect to the natural tensioning path between the underlying rotary part and the upper part from which the thread exits.

This delaying effect further increases the inclination of the spiral formed by the thread of the inner balloon which, from the point at which it exits from the friction element a to the lower drawing point, covers an angle which reaches 180° and more.

In one possible embodiment of the invention, the friction element consists of a bell element facing downwards and forming a single piece with the container.

According to a variant, the bell element is an autonomous element which constitutes a continuous extension of the container and is of the type which can be exchanged with other elements, different in shape, size and/or finishing according to the threads being worked.

A preferential material for the bell element is stainless steel, treated in the appropriate manner, or chromed and polished steel, or anodised aluminum or ceramic, with the appropriate surface finish.

The inclusion of the friction element, which encourages the formation of a balloon in partial contact with the outer wall of the container, means that speeds can be used for the inner balloon which are near those of the outer balloon.

Moreover, it also means that the outer balloon can be maintained near the container, so that the speed of the outer balloon can be very high, thus increasing production and reducing energy consumption.

According to the invention, the outer balloon assumes the shape and size typical of a free balloon of a two-for-one twist spindle and is guided only at the lower part of the spindle as far as a height which is substantially equal to the height of the bobbin-bearing support.

To be more exact, the outer balloon extends on the outside of the inner balloon without any separating elements between the two; therefore the outer balloon has a start-of-cycle position, when the spindle is stationary, wherein it substantially rests on the wall of the container within which the bobbin is located According to a variant, the outer balloon is controlled by an outer container.

The two rotary parts and the bobbin-bearing support are supported and commanded on one side only, where there is the structure to support the spindle.

On the same side, the ceramic inversion element and the friction return element of the first balloon are also supported, by means of the same container or the relative cover.

The threads are drawn into rotation by the two rotary parts, wherein the inner rotary part consists of a bell mounted on the structure to support the spindle which defines inside itself a channel to guide the thread.

The outer rotary part consists of a hollow shaft defining inside itself a channel to guide the thread; at the upper part it is completed by a rotatable element.

The rotatable element may be associated at the upper part with a cone or calyx with a relative auxiliary pulley for the thread in the typical shape of two-for-one twist spindles.

By using the appropriate unwinding devices, tensioning devices and stop-twists above the bobbin and before the ceramic inversion element, contained inside the container, the thread of the inner balloon with its descending path will have a tension which is stabilised at a desired level; this ensures that the inner balloon, at the appropriate speeds, will have the desired shape.

The unwinding device, tensioning device and stop-twists are supported by the cover of the container or the container itself.

According to a variant, there is a further unwinding device supported by the bobbin support.

The path of the thread is achieved, on the support and command side, with as few diversions as possible and with diversion means and inversion-of-direction means made of materials with very low friction, for example alumina with zircon oxide, so as to guarantee a low difference in tension between the two balloons.

According to a variant, the inversion-of-direction means are rotatable, for example they consist of a wheel or roller.

The outer rotary part is commanded in a traditional manner, like two-for-one twister spindles, for example with drive belts, belting or straps, individual motors, etc.

The innermost rotary part, according to the invention, is commanded by a brushless motor.

According to the invention, the magnets of the motor rotor are mounted on the inner rotary part while the stator is mounted outside the outer rotary part.

Between the rotor and the stator there is the lower part of the outer rotary part, inside which the channel which guides the thread is defined.

The embodiment using the brushless motor is very efficient in terms of energy consumption, mechanical simplicity of the spindle and the machine, strength and stability of the spindle, the regulation of the speed of the balloon.

Moreover, it is much easier to control the start and stop slopes or transient times, particularly to delay or slow down, at start-up, the departure of the inner balloon with respect to the outer balloon and, vice versa, to accelerate or speed up the stopping of the inner balloon with respect to the outer balloon when stopped At start-up and stop the two balloons, or rather the ascending and descending thread, are in contact with the container and with each other.

Experience has shown however that if, by delaying start-up or by means of a difference in speed between the respective starting slopes, the outer balloon is caused to expand before the inner balloon starts off, then all risks of damaging and breaking the thread are totally eliminated.

Moreover, by using brushless motors it is possible to stop the inner rotary part at an opportune position, thus facilitating threading operations.

These advantages are further accentuated when the outer rotary part is also commanded by brushless motors.

According to a variant, the inner rotary part is commanded by means of a magnetic pulley associated with an outer command.

ILLUSTRATION OF THE DRAWINGS

With reference to the attached Figures, which are given as a non-restrictive example, we shall now see some embodiments of the invention as follows:

FIG. 1 shows a spindle for two +two twists according to the invention, driven by brushless motors;

FIG. 2 shows a variant of FIG. 1 with a container for the outer balloon;

FIG. 3 shows a part view of a variant of FIG. 2.

DESCRIPTION OF THE DRAWINGS

The attached Figures show several forms of embodiment, which do not include all the possibilities, of spindles 10 suitable to impart to the thread F two+two twists for every rotation of the rotary part of the spindle 10 itself.

The first two Figures show examples of embodiments wherein all the command devices, the unwinding devices, the tensioning devices etc. are inter-changeable and can be associated with one embodiment or the other.

Figure 1:
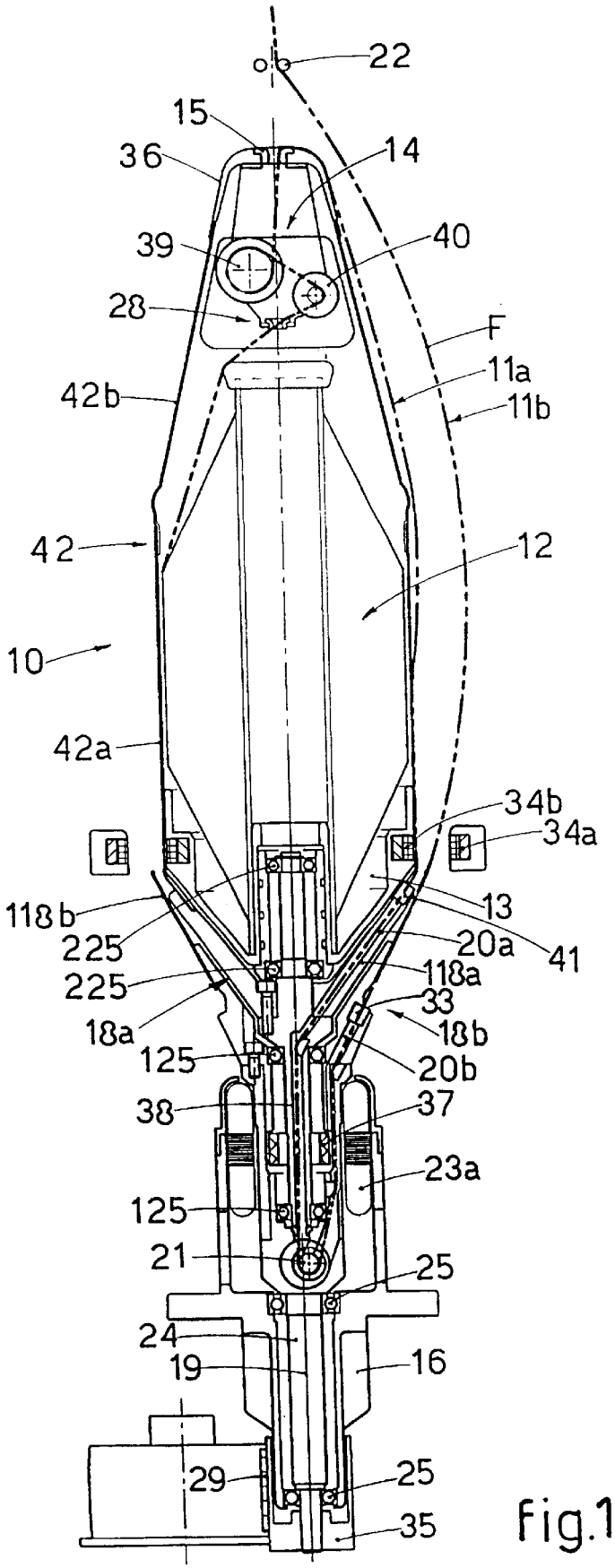

"Two+two twists" is intended to express the concept that the thread F receives two twists for every revolution of the inner rotary part plus two twists for every revolution of the outer rotary part.

The spindle 10 is mounted on a spindle support, indicated generally by the reference number 16, which supports the outer rotary part by means of first bearings 25.

The outer rotary part supports, by means of second bearings 125, the inner rotary part which supports, just as in a two-for-one twist spindle, and by means of further third bearings 225, the bobbin-bearing support 13 which supports the bobbin 12 and the substantially closed container 42.

In this case, the container 42 has a lower part 42*a* and a removable cover 42*b* in order to load the bobbin 12.

According to a variant, the container 42 is substantially made in a single piece and can be removed from the support 13.

The spindle 10 according to the invention achieves a configuration of a double balloon type, respectively an inner balloon 11*a* and an outer balloon 11*b*, making the thread F leaving the feed bobbin 12 follow a double ascending/descending path outside the container 42 and outside the bobbin 12 itself.

In the case shown in FIG. 1, the feed bobbin 12 is of the so-called cop conformation.

The container 42 and the bobbin 12 are held stationary by permanent magnets, respectively outer magnets 34*a* and inner magnets 34*b*.

The thread F unwinding from the bobbin 12 first cooperates with an unwinding device 28 and a pre-tensioning, tensioning and stop-twist device 14, which will be better described hereinafter; then it exits from the ceramic inversion element 15 arranged above the bobbin 12 and is taken downwards again.

The device 14 and the ceramic inversion element 15 are supported by the container 42 and located inside thereof.

Above the container 42, in a continuous piece therewith, there is a bell-type friction element 36 facing downwards and with a central hole.

The bell element 36 may be in a single piece with the container 42 or it may be an autonomous element mounted thereon.

The combined container 42/bell element 36 completely encloses the bobbin 12 as far as the first point at which the thread F inverts direction, as defined by the upper ceramic inversion element 15.

Due to the presence of the bell element 36, and also to the choice of the appropriate values of tension and speed, the thread F is induced to take on a collapsed development with a very inclined spiral adhering to the outer wall, firstly of the bell element 36 and then, at least partly, for its lower segment, of the container 42.

To be more exact, the contact surface of the bell element 36 on which the thread F runs as it leaves the inversion element 15 achieves a slow-down effect which draws back the thread with respect to its natural outlet; this gives a consequent increase in the inclination of the spiral defined between the upper part and the lower part of the spindle 10.

This increases the collapsed effect of the inner balloon 11*a* and therefore, even in those segments where it is not in contact, the thread F still remains in any case very close to the outer wall of the container 42.

Thanks to the substantial adherence or in any case proximity of the inner balloon 11*a* to the container 42, with the consequent optimum control and stabilisation of the tensions, and the absence of separator elements between the inner balloon 11*a* and the outer balloon 11*b*, it is possible to limit the size of the outer balloon 11*b*, and thus to obtain very high production and speeds with a considerable saving of energy.

In a suitable position near the base of the feed bobbin 12, the thread F, after being taken into contact with the ceramic drawing element 41, is introduced into the transit channel 20*a* of an inner rotary part 18*a*, in this case consisting of the shaft 38 and the bell rotary element 118*a* facing upwards and arranged coaxial with the axis 19 of the spindle 10.

In a coaxial position and outside the inner rotary part 18*a* there is an outer rotary part 18*b*, consisting of a rotary transit channel 20*b* through which the thread exits and which is completed, after the ceramic drawing element 33, by a calyx element and/or pulley 118*b* which function as back-up elements and to stabilise the outer balloon 11*b*.

The thread F, having substantially reached the axis 19 of he spindle, follows the last segment of the descending path inside the inner hollow shaft 38 of the inner rotary part 18*a*, enters the hollow shaft 24 of the outer rotary part 18*b*, inverts its direction in correspondence with a revolving inversion roller 21 and is guided upwards inside the transit channel 20*b*, so as to come out in correspondence with the ceramic drawing element 33.

The revolving roller 21 has its axis of rotation orthogonal to the vertical plane whereon the axis 19 of the spindle 10 lies, and intersects the said plane substantially in correspondence with or in close proximity to the said axis 19.

Thanks to the revolving roller 21 mounted on the outer rotary part 18*b*, and thanks also to the path of the transit channels 20*a* and 20*b* with its minimal diversions, it is guaranteed that the thread F will have a limited and not excessive difference in tension between the inner balloon 11*a* and the outer balloon 11*b*, thus ensuring that the speed of the inner balloon 11*a* is close to that of the outer balloon 11*b*.

With a tension of the inner balloon 11*a* equal to 50÷60% of the tension of the outer balloon 11*b*, the speed of the inner balloon 11*a* has a value in the order of 70÷80% of that of the outer balloon 11*b*.

Therefore, the thread F runs upwards the whole length of the spindle 10 until it reaches the thread loop 22 and is sent to the collection systems, which are not shown here.

The inner rotary part 18*a* and the outer rotary part 18*b* each cause two twists on the thread F for each revolution on their axis, which coincides with the axis 19 of the spindle 10.

In the case shown in FIG. 1, the outer rotary part 18*b* is commanded in a traditional manner by means of the pulley 35 and the belt 29 which act on the shaft 24 of the outer rotary part 18*b*.

The inner rotary part 18*a* is commanded by means of a brushless motor wherein the stator 23*a* commands the magnets 37 of the rotor which are mounted on the shaft 38 of the inner rotary part 18*a*.

The pre-tensioning, tensioning and stop-twist device 14, attached inside the bell element 36, is arranged above the bobbin 12 and before the ceramic inversion element 15 and cooperates with an unwinding device 28 consisting of a thread loop or a ceramic ring.

In the case shown in FIG. 1, the device 14 consists of a tightener including caps 40 and a magnetic tensioner 39, whose braking/drawing disks also carry out a twist-stop function, that is to say, they prevent the twists from causing problems to the thread F in the tensioning and unwinding area.

Figure 2:
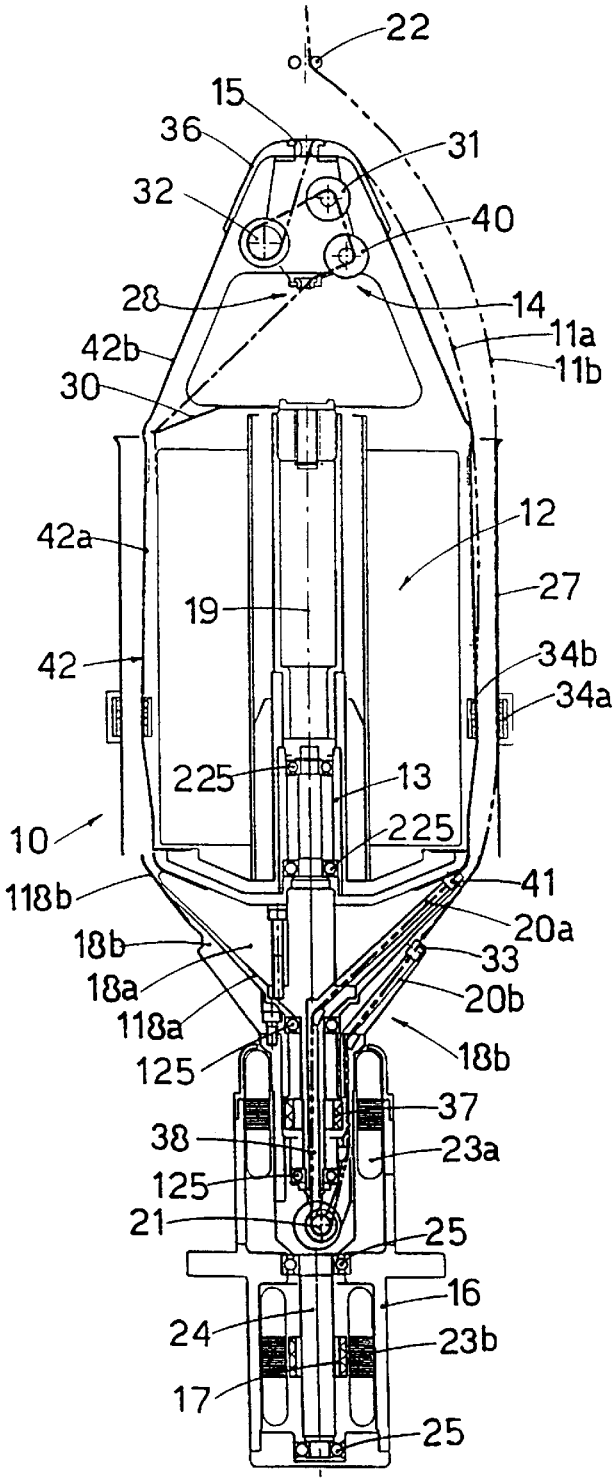

With reference to FIG. 2, the same reference numbers are used to indicate identical parts or parts with the same function as those described in FIG. 1.

This figure shows the variant which provides that the outer balloon 11*b*, commanded by the outer rotary part 18*b*, is limited by an outer stationary container 27 and that the feed bobbin 12 is a cylindrical bobbin.

The device 14, which in this case too is located inside the container 42 and the bell element 36, consists of a tightener 40, a tightener 31 including caps and a roller stop-twist 32.

The unwinding device consists of a revolving unwinder 30, supported by the bobbin support 13 and the thread loop 28.

The two rotary parts, the inner rotary part 18*a* and the outer rotary part 18*b*, are both commanded, in this case, by brushless motors.

To be more exact, the stator of a first brushless motor 23*b* drives the outer rotary part 18*b* by means of magnets 17 attached to the shaft 24 of the outer rotary part 18*b*, while the inner rotary part 18*a* is driven by the stator 23*a* of a second brushless motor which has the magnets 37 attached to the shaft 38 of the inner rotary part 18*a*.

The thread F may be threaded into the rotary parts by inserting the thread itself manually onto the unwinding devices 28 and 30 and onto the ceramic element, 15 which are present above the bobbin 12, with pneumatic threading means such as are known to the art and are not shown here, as in certain two-for-one twist spindles.

Figure 3:
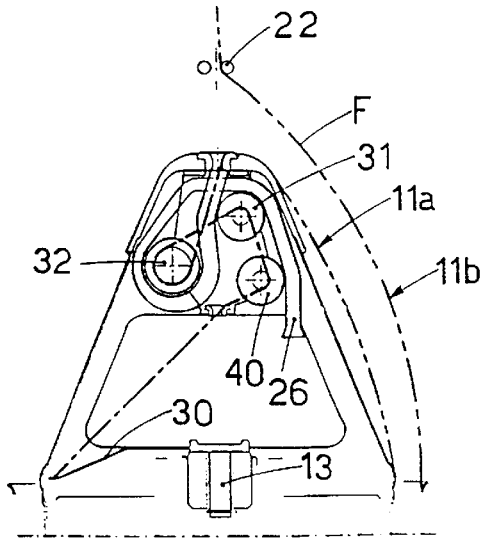

In order to facilitate the threading of the thread F onto the upper part of the container 42, in cooperation with the device 14 and the ceramic element 15, there is a threader pipe 26 (FIG. 3) with a longitudinal slit through which the thread exits, so that the thread may be threaded pneumatically, by means of a blast of air and aspiration.

What is claimed is:

1. A multiple twist spindle to impart two plus two twists to continuous and discontinuous textile yarns and threads, the spindle comprising a spindle support which supports a bobbin support for a feed bobbin maintained substantially stationary to two counter-rotating parts, an inner rotary part and an outer rotary part, the counter-rotating parts being coaxial to each other and substantially coaxial to an axis of the spindle, a thread unwinding from the feed bobbin and leaving an upper inversion element located above the feed bobbin induced by the counter-rotating parts to follow a path which first descends and then ascends, the thread is then sent to a collection mechanism, the path defines an inner balloon and an outer balloon rotating outside the feed bobbin, the thread receiving two twists for each revolution of each of the counter-rotating parts, a tensioning device is positioned above the feed bobbin, wherein all commands and supports for the counter-rotating parts, the tensioning device and the upper inversion element are located on a single side of the spindle adjacent the spindle support, the feed bobbin is located inside a substantially closed container which extends substantially from the spindle support to the upper inversion element and the inner balloon with a descending path assumes a path which is at least partly collapsed on an outer wall of the container while the outer balloon with an ascending path expanded outwards assumes a substantially free path guided only in one portion of its lower part.

2. The Spindle as in claim 1, wherein between the inner balloon and the outer balloon there is no separator element, the outer balloon having a start-of-cycle position with the spindle stationary wherein the outer balloon rests on the outer wall of the container.

3. The Spindle as in claim 1, comprising an outer stationary container to contain and limit the outer balloon.

4. The Spindle as in claim 1, wherein an upper part of the container has a friction element having a wall upon which the thread rests in a first segment of the descending path.

5. The Spindle as in claim 4, wherein the friction element has a contact surface lin contact with the thread which functions as a braking element for the thread emerging from the container.

6. The Spindle as in claim 4, wherein the friction element formed integrally with the container.

7. The Spindle as in claim 4, wherein the friction element is an autonomous element and can be replaced according to the type of fiber being worked.

8. The Spindle as in claim 4, wherein the friction element is shaped generally like a bell.

9. The Spindle as in claim 1, wherein the counter-rotating parts are comprised of guide and transit channels for the thread.

10. The Spindle as in claim 1, wherein at a point where the thread inverts direction from a descending path to an ascending path there is below the bobbin at least a revolving inversion roller whose axis of rotation is orthogonal to a vertical plane on which the axis of the spindle lies.

11. The Spindle as in claim 1, wherein the tensioning device is supported inside the container.

12. The Spindle as in claim 1, wherein the tensioning device comprises a magnetic tensioner.

13. The Spindle as in claim 1, wherein the tensioning includes a tensioning and stop-twist device.

14. The Spindle as in claim 4, wherein the upper inversion element is supported inside the friction element.

15. The Spindle as in claim 1, further including a pipe with a longitudinal slit through which the thread emerges, the pipe facilitates pneumatic threading of the thread in cooperation with the tensioning device and the upper inversion element.

16. The Spindle as in claim 1, wherein the inner rotary part is commanded by a magnetic pulley associated with an external controller.

17. The Spindle as in claim 1, wherein the inner rotary part is controlled by a brushless motor.

18. The Spindle as in claim 17, wherein the outer rotary part is controlled by a brushless motor.

19. The Spindle as in claim 16, wherein the outer rotary part is controlled by a belt and a pulley.

* * * * *